US007451985B2

(12) United States Patent
Giermek

(10) Patent No.: US 7,451,985 B2
(45) Date of Patent: Nov. 18, 2008

(54) ROTATIONAL RING PUZZLE

(76) Inventor: Adam Giermek, 3549 Rosewood Ave., Los Angeles, CA (US) 90066

( * ) Notice: Subject to any disclaimer, the term of this patent is extended or adjusted under 35 U.S.C. 154(b) by 0 days.

(21) Appl. No.: 11/518,051

(22) Filed: Sep. 8, 2006

(65) Prior Publication Data

US 2008/0061503 A1 Mar. 13, 2008

(51) Int. Cl.
*A63F 9/08* (2006.01)

(52) U.S. Cl. ..... 273/153 S

(58) Field of Classification Search ..... 273/157 R, 273/153 S

See application file for complete search history.

(56) References Cited

U.S. PATENT DOCUMENTS 4,452,454 A * 6/1984 Greene ..... 372/153 S
4,553,754 A * 11/1985 Wiggs et al. ..... 273/153 S
5,566,941 A * 10/1996 Destics ..... 273/153 S
5,836,584 A * 11/1998 Chen ..... 273/153 S
6,857,632 B2 * 2/2005 Tanner ..... 273/153 S
2007/0057456 A1 * 3/2007 Liu ..... 273/153 S

FOREIGN PATENT DOCUMENTS

EP 578621 A1 * 1/1994
GB 2088728 A * 6/1982

* cited by examiner

*Primary Examiner*—Steven Wong
(74) *Attorney, Agent, or Firm*—Maria Erlinda Co Sarno

(57) ABSTRACT

A spherical puzzle comprising a first semi-spherical shell engaged with a second semi-spherical shell. Each shell has four triangular panels held by a plate with the four triangular panels on each plate forming an intersecting track running perpendicularly along an x and y axis. The track on the x axis of the second semi-spherical shell forms a continuous track with the track on the x axis of the first semi-spherical shell and the track on the y axis of the second semi-spherical shell forms a continuous track with the track on the y axis of the first semi-spherical shell. A plurality of sliding tiles forming a predetermined pattern or design are placed on the intersecting tracks. One semi-spherical shell can rotate relative to the other semi-spherical shell about an equatorial axis.

20 Claims, 9 Drawing Sheets

ROTATIONAL RING PUZZLE

BACKGROUND

This invention relates to a spherical puzzle with two tracks at right angles from each other forming two intersecting rings of sliding tiles located at the circumferential periphery of the sphere having multiple sliding tiles on each track or ring, the sliding tiles together forming a predetermined pattern of color or design which can be scrambled and rearranged to restore the predetermined pattern of design or color.

There are a variety of spherical puzzles with intersecting tracks around the periphery having moving slides or sliding pieces. For example, the spherical puzzle toy of Tsun Ding Chen, U.S. Pat. No. 5,836,584, comprises two semi-spherical shells (22) that are joined inside the hollow shell by a sleeve (23) on the inside center of one of the semi-spherical shells and a split rod (24) with a coupling portion (26) on the other semi-spherical shell. In this puzzle, partition panels are mounted on the periphery of the spherical base formed after the joining of the two semi-spherical shell. Eight of these partition panels spaced from one another around the spherical base define three intersected annular tracks, the X-track (201), the Y-track (202), and the Z-track (203). The slides (4) move on these tracks to form the desired pattern. The construction of this puzzle requires the mounting of partition panels by hooks lodging on openings at the surface of the spherical base. These connections can break or loosen up with repeated usage. The partition panels can also get loose and get lost. Additionally, more material is required to make the puzzle and the design is complex.

U.S. Pat. No. 4,889,340 issued to Wilton R. Greene is also a spherical puzzle and like Chen, it also has a spherical support member (12) comparable to the spherical base of Chen which carries on its surface, radially protruding circumferentially extending tracks (20). Movable members are straddingly carried on the circumferential tracks (20). Spring flanges (24) prevent the movable members (22) from falling off the circumferential track (20). Like Chen, the construction of this puzzle is also complex requiring the spherical support member to carry on its surface, radially protruding circumferential tracks for the movable members to move relative to the spherical support member. It is also not so sturdy because the spring flanges that hold the movable members can break or fall apart with time and usage because these are simply connected to the side walls (17) of the track. Further, none of the above puzzles have the same rules or challenges in restoring a predetermined pattern after scrambling the pattern as the claimed invention.

It is therefore an object of this invention to produce a spherical puzzle that is simple in construction.

It is also an object of this invention to have a puzzle wherein the moving members or sliding tiles move from tracks within the spherical base and not from tracks formed by externally attached components that could break or get disengaged and lost with usage.

It is a further object of this invention to provide another puzzle having different levels of complexity with a different set of movements for scrambling and restoring a predetermined pattern.

SUMMARY OF THE INVENTION

This invention relates to a spherical puzzle, comprising a first semi-spherical shell having four triangular panels held by a first plate with the four triangular panels forming an intersecting track having a center cut running perpendicularly along an x and y axis. The first semi-spherical shell is engaged with a second semi-spherical shell also having four triangular panels held by a second plate. The second semi-spherical shell also has four triangular panels forming an intersecting track having a center cut running perpendicularly along an x and y axis. The track on the x axis of the second semi-spherical shell forms a continuous track with the track on the x axis of the first semi-spherical shell and the track on the y axis of the second semi-spherical shell forms a continuous track with the track on the y axis of the first semi-spherical shell. A plurality of sliding tiles forming a predetermined pattern or design are placed on the intersecting tracks. The triangular panels at each first and second semi-spherical shell are identical. A triangular panel covers approximately one-eight of a sphere. The triangular panel has an outer curved surface having raised ridges along the three sides of the triangular panel. The raised ridges on the lateral sides are recessed from the edges of the lateral sides of the triangular panel to form a track having a center cut along the track after the triangular panels are held by the plates of the semi-spherical shells. The triangular panel is recommended to have an interior supporting wall that forms a hollow compartment which also serves as a connector for the triangular panel. A rib running longitudinally along an outer edge of the supporting wall reinforces the supporting wall. The triangular panels attach to the front side of the first and second plate while the bottom side of the first and second plates engages with each other to form the spherical shell. At four positions on the bottom side of the first plate spaced at 90 degrees from each, are nibs aligning with the center cut along the intersecting tracks. Matching these nibs are shallow troughs on the bottom surface of the second plate. The bottom surfaces of the first and second semi-spherical shells are flat after engagement except for the nibs on the first semi-spherical shell and the matching troughs on the second semi-spherical shell at 90 degrees from each other. This allow rotation of the first semi-spherical shell about the equatorial axis in increments of 90 degrees in relation to the second semi-spherical shell wherein one nib transfers from one trough to an adjacent trough. One sliding tile is at a junction of the intersecting track at the first semi-spherical shell and another sliding tile is at a junction of the intersecting track at the second semi-spherical shell when one semi-spherical shell rotates at a direction against the position of the other semi-spherical shell. Each track on a semi-spherical shell contain a minimum of three sliding tiles. The sliding tile has a top section having a top face and a base and a thin plate connected to the top section by a center piece. The center piece is situated at the center cut of the intersecting tracks. The centerpiece connects the thin plate located at the inside surface of the track with the top section located on the top surface of the semi-spherical shell. The thin plate has a width larger than the width of the center cut to keep the top section of the sliding tile or the sliding tile as a whole from falling off the track, as well as provide balance for the top section. The predetermined design on the sliding tile is visually detectable or in patterned protrusion for the blind. The pattern or design in one track may be coordinated or independent from the pattern or design from the other track.

Other embodiments of the present invention will become readily apparent to those skilled in the art from the following detailed description, wherein it shows and describes only certain embodiments of the invention by way of illustration. As will be realized, the invention is capable of other and different embodiments and its several details are capable of modification in various other respects, all without departing from the spirit and scope of the present invention. Accordingly, the drawings and detailed description are to be regarded as illustrative in nature and not as restrictive.

BRIEF DESCRIPTION OF THE DRAWING

Aspects of the present invention are illustrated by way of example, and not by way of limitation, in the accompanying drawings, wherein.

DETAILED DESCRIPTION OF THE INVENTION

Figure 1:
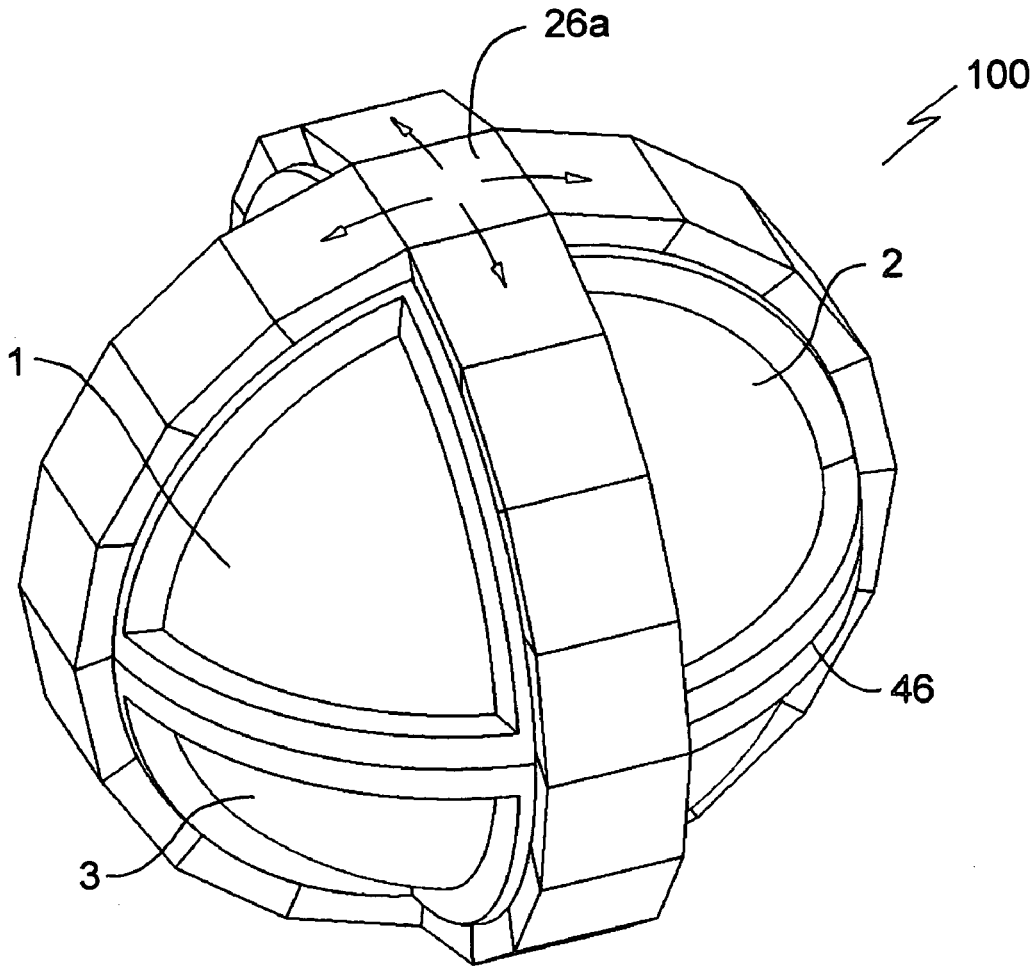
FIG. 1 is a perspective view of the rotational ring puzzle in a three dimensional structure.

The spherical rotational ring puzzle 100 shown in FIG. 1 is constructed by eight identical triangular panels 1, four of which forms a first semi-spherical shell 2 while the other four forms the second semi-spherical shell 3. The first semi-spherical shell is also referred to herein as the female semi-spherical shell while the second semi-spherical shell is also referred to herein as the male semi-spherical shell. The four triangular panels 1 forming the first semi-spherical shell 2 are held by a first or female plate 4 while the other four triangular panels 1 forming the second semi-spherical shell 3 are held by a second or male plate 5. The spherical rotational ring puzzle is formed by the engagement of the female plate with the male plate.

Figure 2:
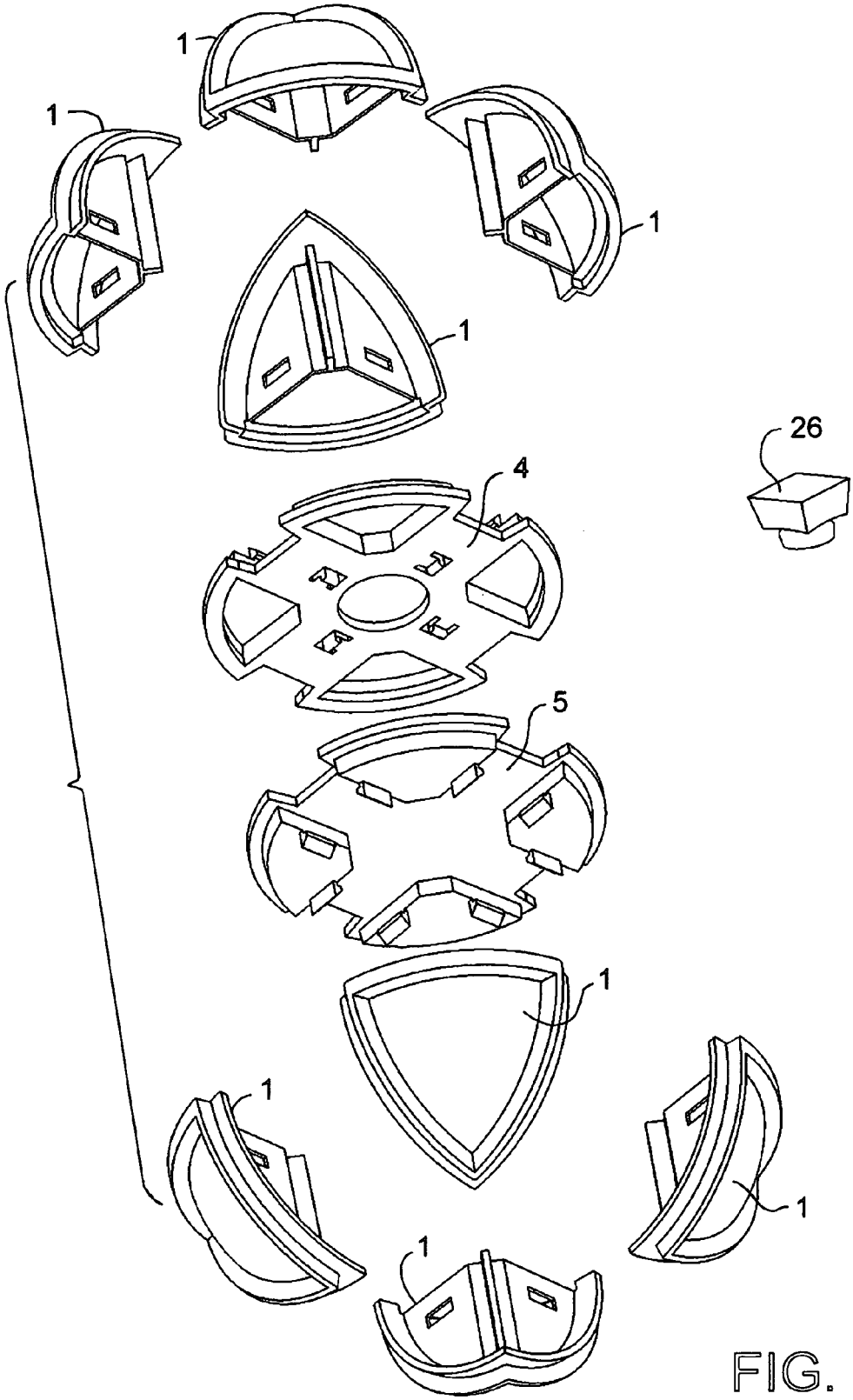
FIG. 2 is an exploded view of the components of the rotational ring puzzle.

An exploded view of the components of the rotational ring puzzle is shown in FIG. 2. By making eight identical triangular panels with two matching plates, this simplifies the construction or assembly of the ring puzzle as well as cut the cost of making the molds. Further, with identical triangular panels, it is easy to replace a triangular panel if it accidentally gets detached, break or lost from any one of the plates without throwing away the entire ring puzzle.

Figure 3:
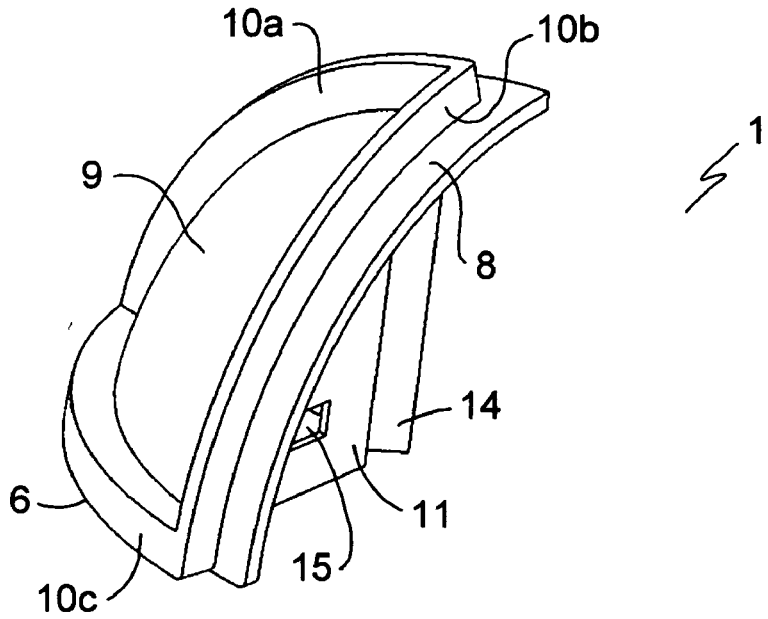
FIG. 3 is a perspective view of a triangular panel.
Figure 4:
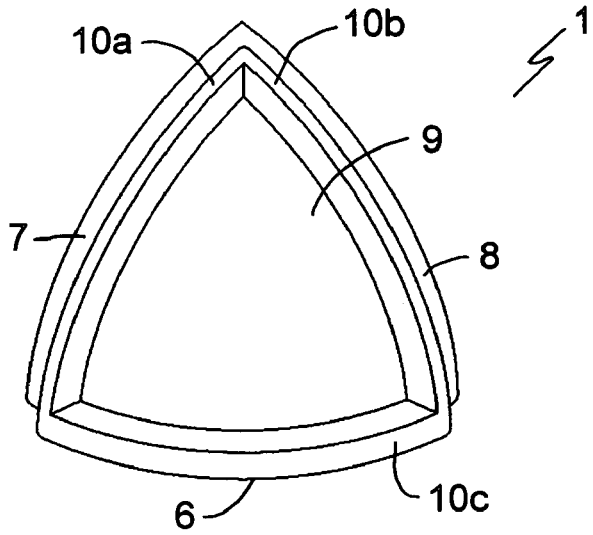
FIG. 4 is a front view of a triangular panel.
Figure 5:
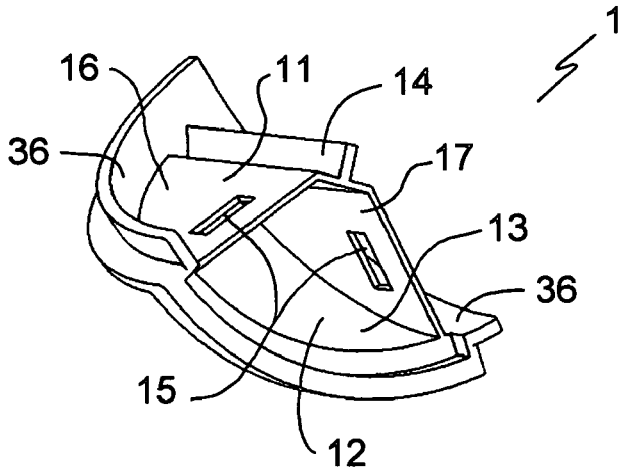
FIG. 5 is a perspective back bottom view of a triangular panel.

A triangular panel 1 covers approximately ⅛ of a sphere. FIG. 3 and FIG. 4 show a perspective and front view of a triangular panel 1, respectively. Each triangular panel has three sides, 6, 7, and 8. The panels have an outer curved surface 9 and consequently, sides 7 and 8 are also curved to enable the formation of a sphere after the eight triangular panels are interconnected. It is recommended to mold the triangular panel as a single piece. The outer curved surface 9 has raised ridges 10*a,b,c*, along the three sides 6, 7, and 8 with the ridges 10*a* and 10*b* recessed from the edges of lateral sides 7 and 8 while the bottom ridge 10*c* is flushed on the same plane as the outer edge of side 6 as shown in FIGS. 3 and 4. Side 6 is at the peripheral bottom of the formed semi-spherical shell when the triangular panels are attached to a plate. The raised ridge 10*c* may be thicker than the raised ridges 10*a* and 10*b*. The interior of each triangular panel 1 is supported by walls 11 which in this illustration shown in FIG. 5, is trapezoidal in shape. The supporting walls 11 need not be trapezoidal but other geometric shapes are possible. These walls also serve as a connector to other components of the puzzle for the triangular panel. The supporting walls 11 create a hollow compartment 12 between the inner surface 13 of the triangular panel 1 and the walls 11. For further reinforcement, a rib 14 runs longitudinally along an outer edge of the supporting wall 11 proximal to the central core of the sphere. A pair of symmetrically located openings 15 may be etched out from the side walls 16 and 17 of the supporting wall 11 of the triangular panel. Since all eight triangular panels are identical, the parts of the panels will be identified with the same number.

Figure 6:
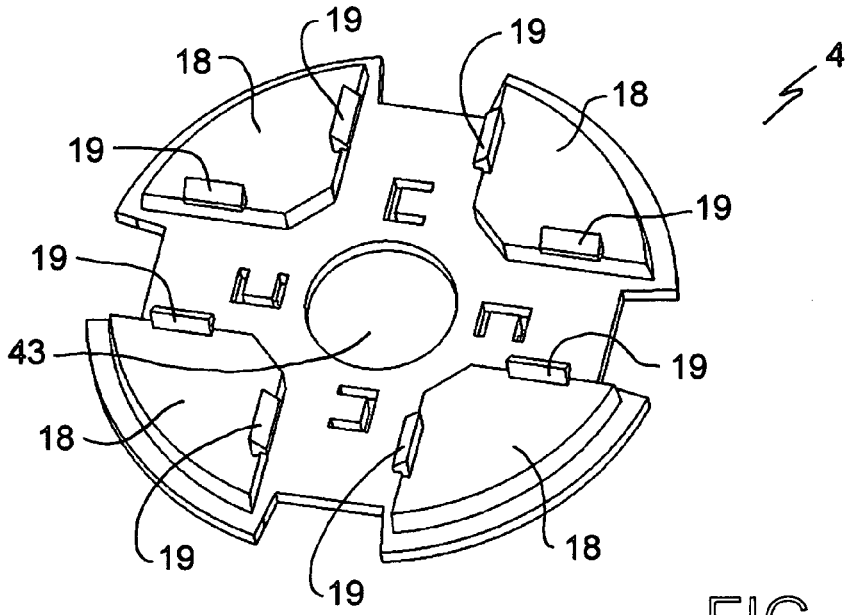
FIG. 6 is a perspective front plan view of a female plate.

Four of these triangular panels are engaged to a round first or female plate 4. FIG. 6 shows the side of the female plate where the triangular panels attach which will be referred to here as the front side. The front side of the female plate 4 has four upstanding platform 18 of a shape adapted for engagement with the hollow compartment 12 of the triangular panels which as stated above can be other than trapezoidal. The shape of the upstanding platform 18 conforms with the contour of the hollow compartment. One upstanding platform 18 inserts snugly into one triangular panel. For a more permanent engagement, retaining hooks 19 protruding upwards from the platform may be provided for engagement with the openings 15 to lock the triangular panels to the upstanding platforms of the female plate. Of course, other means for engaging the triangular panels to the female plate can be designed.

Figure 7:
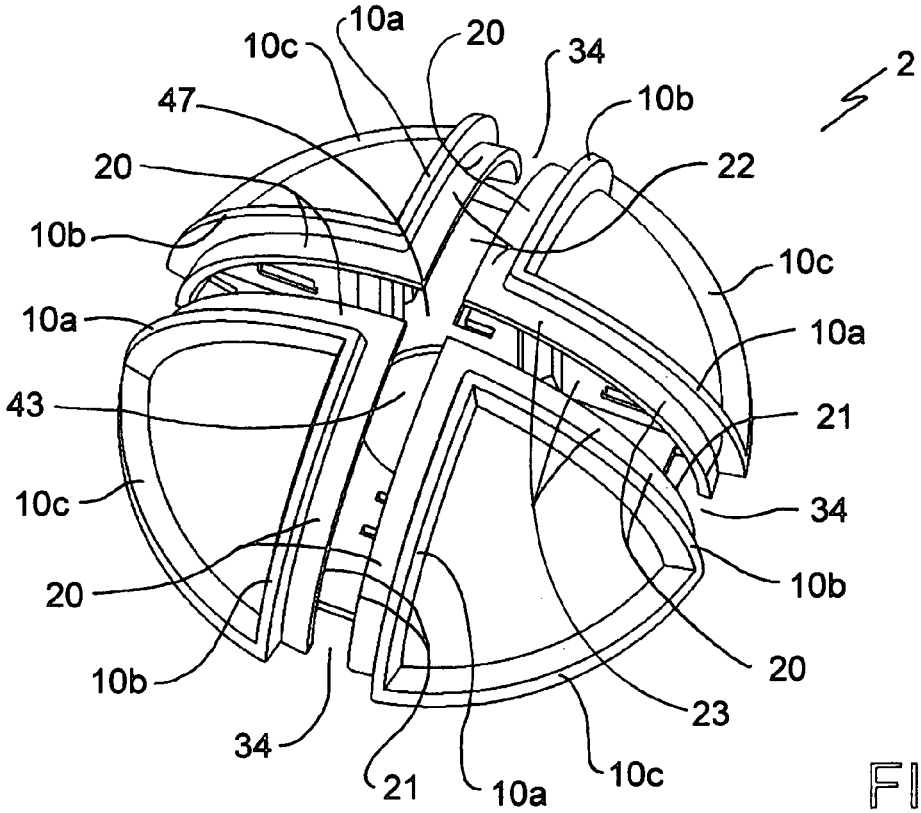
FIG. 7 is a perspective front view of a semi-spherical shell formed after the attachment of four triangular panels into the female plate.
Figure 8:
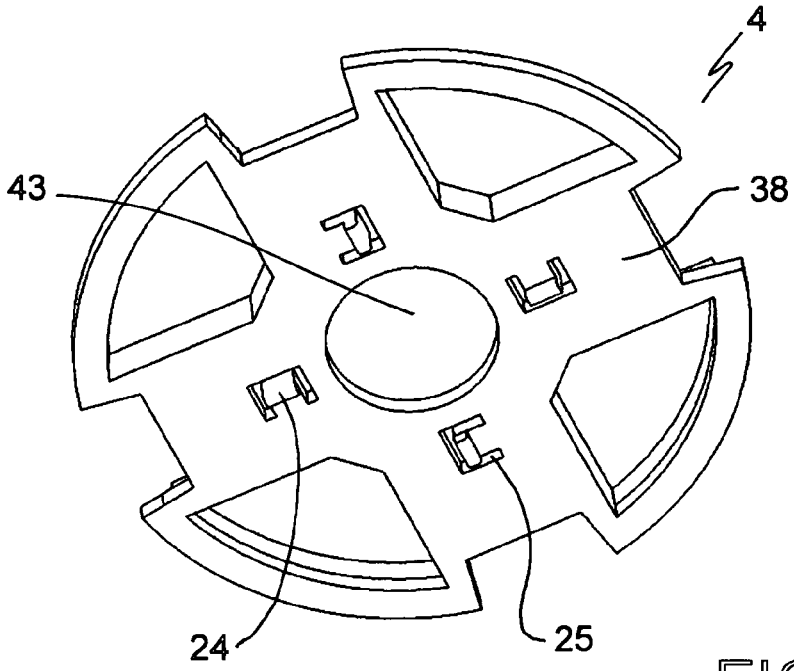
FIG. 8 is a perspective bottom view of a female plate.
Figure 8A:
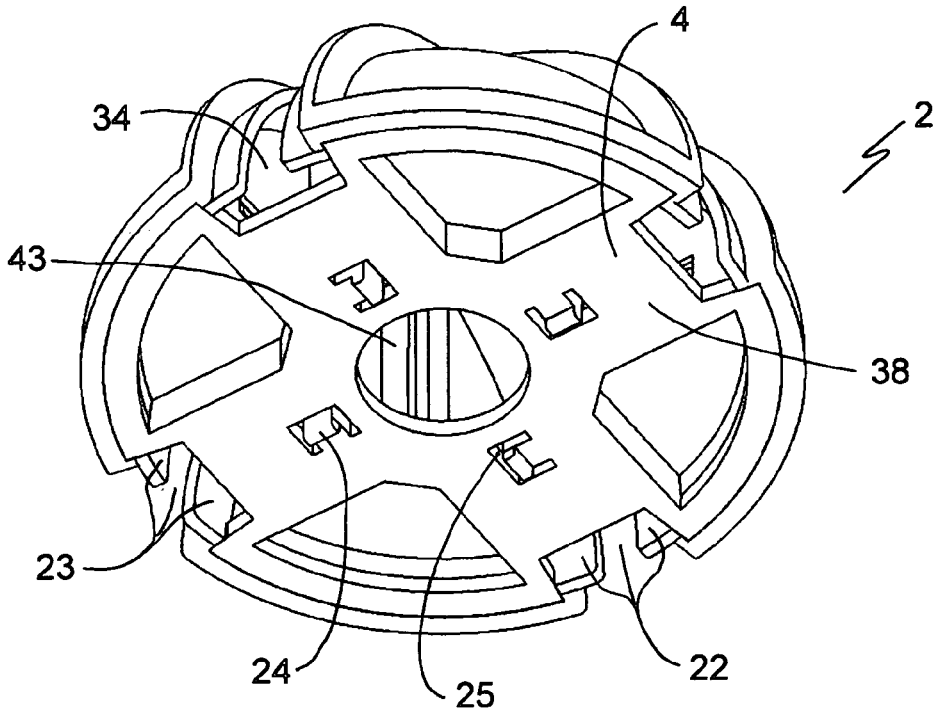
FIG. 8A is a bottom perspective view of a female plate with four triangular panels attached forming a semi-spherical shell.

FIG. 7 shows the first or female semi-spherical shell 2 formed after engagement of four triangular panels into the female plate 4. After engagement, the raised ridges 10*a* and 10*b* and the lateral peripheral surfaces 20 formed by recessing the ridges 10*a* and 10*b* from the edges 21 of the lateral sides 7 and 8 results in an intersecting track 22 and 23 running perpendicularly along the X and Y axis or at 90 degrees from each other. FIGS. 8 and 8A show the bottom side of the female plate 4. Note the protruding rounded tipped nib 24 hanging from one end of a cut out 25 located at four positions on the bottom surface of the female plate 4 spaced at ninety degrees from each other. These nibs 24 on the cut out 25 are usually aligned with the central cut 34 of either track 22 or 23. The cut out with a nib made of a resilient material connected on one of its sides allows the nib some motion to protrude and recess when pushed inward.

Figure 9:
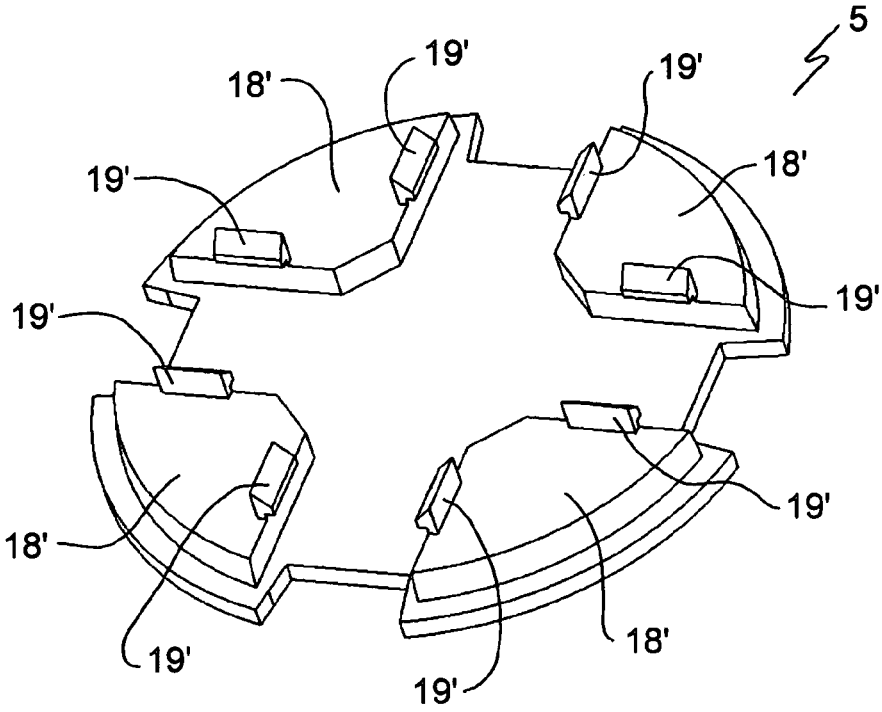
FIG. 9 is a perspective front view of a male plate.
Figure 11:
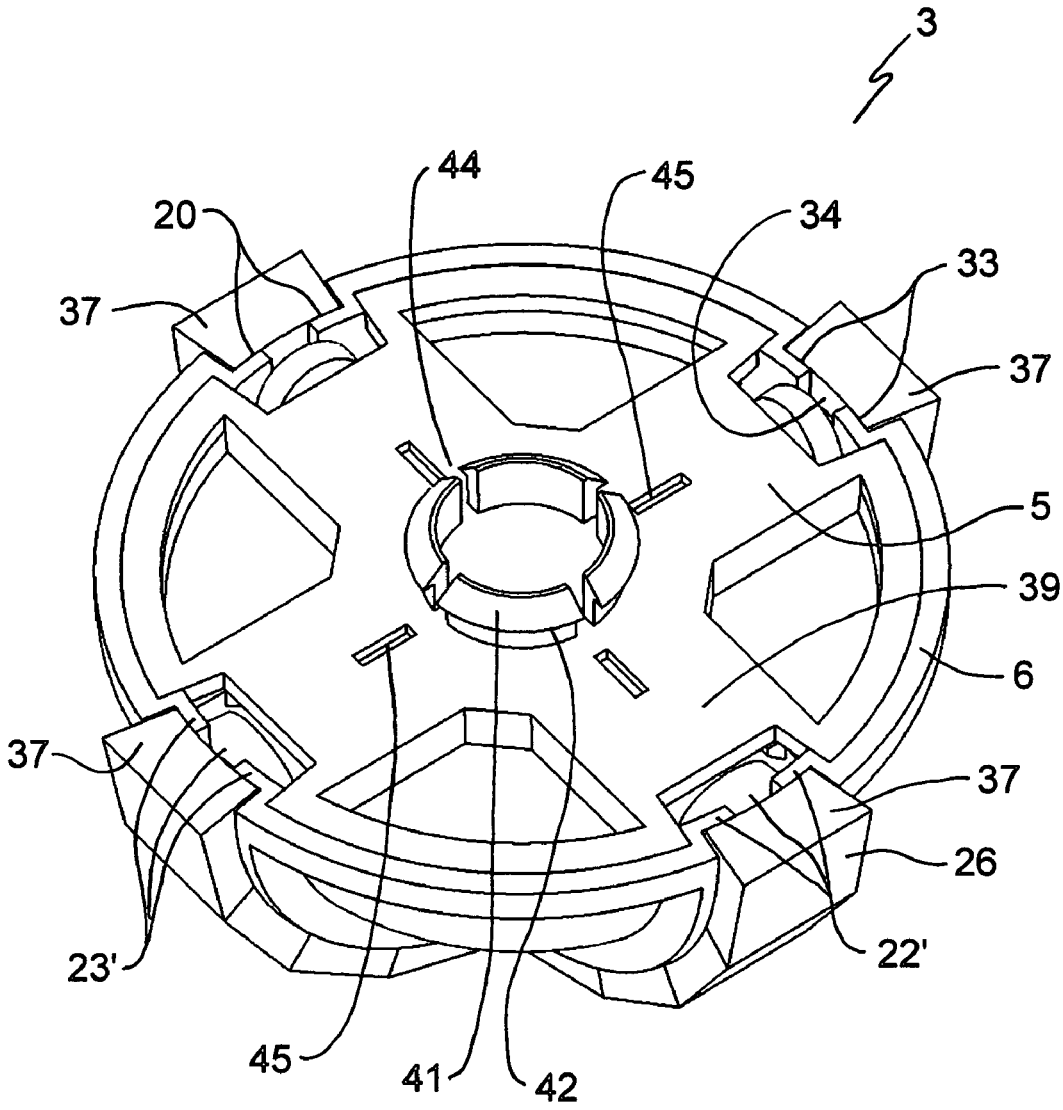
FIG. 11 is a bottom perspective view of a male semi-spherical shell with the sliding tiles introduced into the two intersecting tracks.

The second or male semi-spherical shell 3 forming the other half of the spherical ring puzzle 100 is assembled in the same manner as the first or female semi-spherical shell 2 except that the four triangular panels 1 are engaged with a second or male plate 5 shown in FIG. 9. The side shown in FIG. 9 is herein referred to as front side of the male plate 5. As in the female plate 4, there are also upstanding platforms 18' that snugly inserts into the hollow compartment 12 of the triangular panel 1. Retaining hooks 19' may also be provided for a more permanent engagement. Intersecting tracks 22' and 23' are also formed after the engagement of the four triangular panels on the male plate as shown in FIG. 11. Track 22' on the male semi-spherical shell forms a continuous track with track 22 on the female semi-spherical shell and track 23' on the male semi-spherical shell forms a continuous track with track 23 on the female semi-spherical shell after the engagement of the two semi-spherical shells. Herein, use of the word semi-spherical shell without reference to whether it is the male, female, first or second means that it refers to both.

Figure 2A:
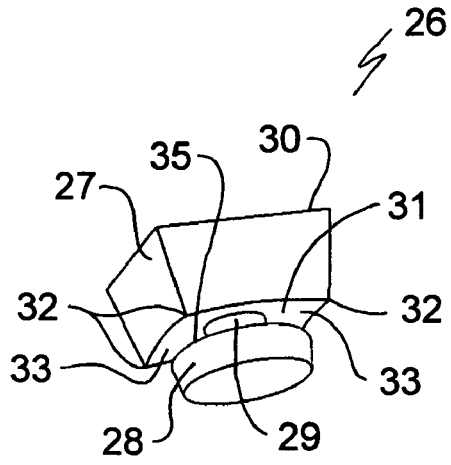
FIG. 2A is a perspective view of a sliding tile.

After each semi-spherical shell is formed, sliding tiles 26 are introduced into the intersecting tracks 22 and 23 and 22' and 23'. Each 180 degree track of a semi-spherical shell contain odd numbers of sliding tiles with a minimum of three. A track in full rotation, that is, 360 degrees or in a continuous ring formation would contain twice the number of sliding tiles 26. FIG. 2A shows an example of a sliding tile 26. The design of the sliding tile is not confined to the example shown. Other sliding tiles can be introduced to the tracks so long as it can move along both tracks.

The sliding tile 26 shown here has a top section 27 shaped like a truncated pyramid connected to a spherical thin plate 28 by a center piece 29 which is a short cylindrical shaft. As stated above, this is just an example, the top section need not be a truncated pyramid, the thin plate need not be spherical and the shaft need not be cylindrical. The top section 27 has a top outside face 30 and a base 31. The top face and the base are shown here as square but other geometric shapes are also possible so long as it can slide along tracks 22 and 23 and 22' and 23'. It is recommended for the peripheral edges and corners of the top face and the base to be curved and smoothened and for the peripheral bottom corners 32 of the base 31 slightly lowered such that a slight arching results. This allows for the two lateral sides 33 of the base 31 to lie along tracks 22, 23, 22' and 23' with the central area of the base 31 not touching the tracks, thereby facilitating the movement of each tile relative to the other.

Figure 10:
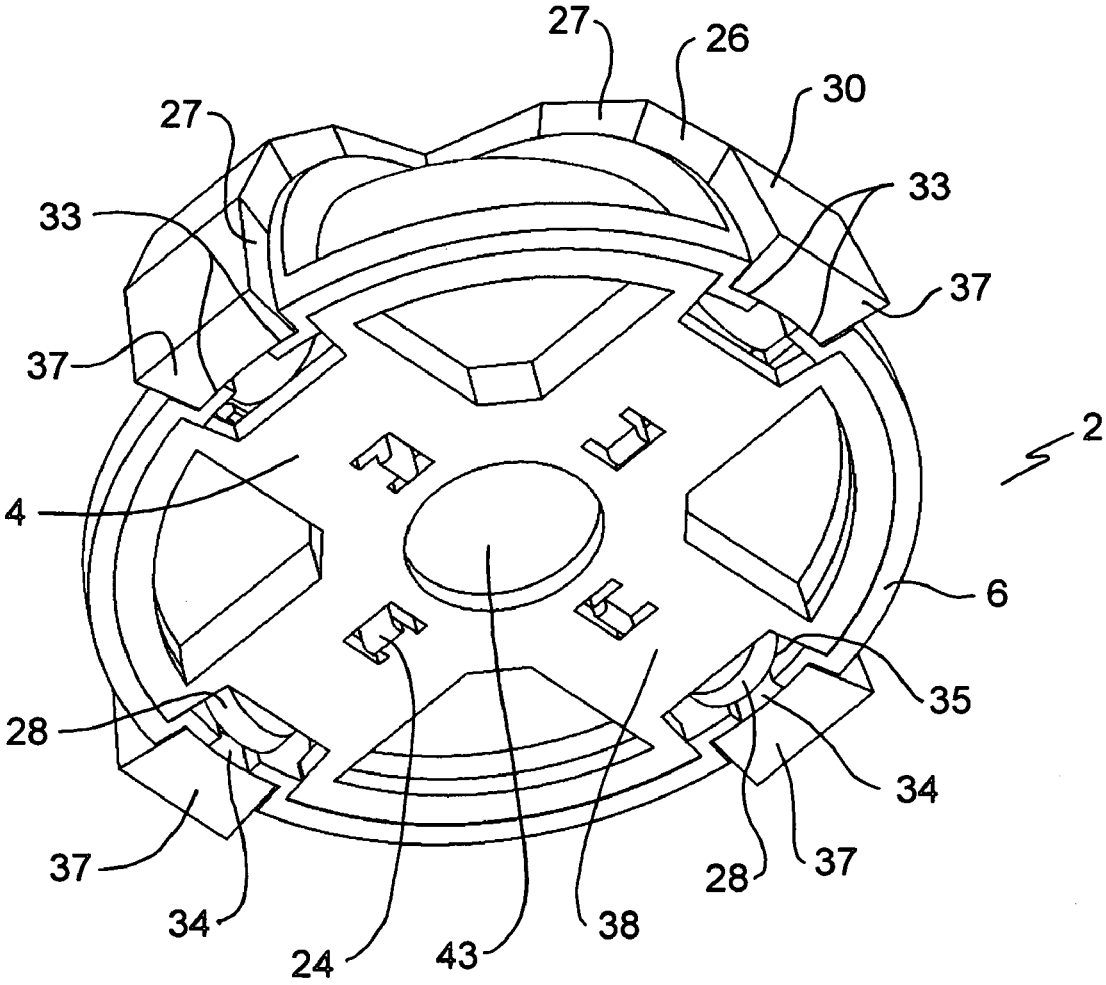
FIG. 10 is a bottom perspective view of a female semi-spherical shell with the sliding tiles introduced into the two intersecting tracks.

The sliding tiles 26 are introduced into tracks 22, 23, 22' and 23' with the lateral sides 33 of the base 31 of the sliding tile resting on the peripheral surface 20 of the tracks as shown in FIGS. 10 and 11. The peripheral surface 20 is shown better in FIG. 7. The top section 27 rests on the top outside surface of the semi-spherical shells with the center piece 29 situating at the center cut 34 along the middle of tracks 22, 23, 22' and 23'. The front side 35 of the thin plate 28 faces the inside surface 36 (see FIG. 5) of the tracks and traverse the tracks on the side opposite of where the top section 27 traverse the semi-spherical shell. A spherical thin plate, shown here as an example of a thin plate, should have a diameter larger than the width of the center cut 34 to prevent the sliding tiles from falling off easily from the tracks as the spherical puzzle 100 is rotated or moved around during use, as well as provide balance for the top section of the sliding tiles. The height of the centerpiece 29 is slightly taller than the thickness of the tracks to allow unobstructed motion of the sliding tiles 26 as it traverse along the center cut 34 of tracks 22, 23, 22' and 23'. The side 37 of the top section 27 of the sliding tile facing side 6 should align with the outer edge of side 6. This is important to enable one semi-spherical shell to rotate about an equatorial axis relative to the other semi-spherical shell.

Figure 9A:
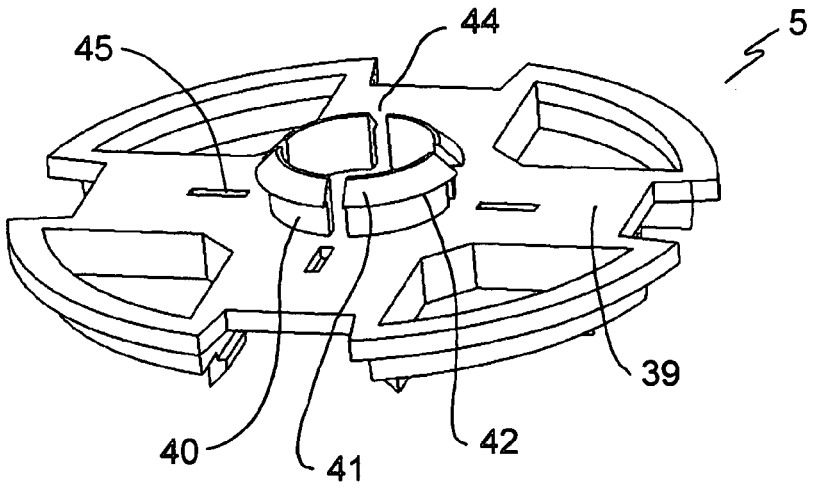
FIG. 9A is a perspective bottom view of a male plate.

FIG. 11 shows the second or male semi-spherical shell formed on a second or male plate 5 with the sliding tiles 26. The spherical puzzle as stated above, is formed by the engagement of the two semi-spherical shells. The bottom side 38 of the female plate 4 as shown in FIGS. 8 and 8A engages with the bottom side 39 of the male plate 5 shown in FIGS. 9A and 11 usually by a snapping mechanism but other similar forms of attachment will also work. In the example here, a circular protrusion 40 at the center of the male plate 5 having a circular lip 41 with slanted edges 42 is inserted into a central hole 43 of the female plate. As shown, the circular protrusion is segmented or cut in sections, herein four but at least one segment with one slit 44 would be sufficient. Slits 44 on the circular protrusion provides flexibility and some resiliency for the circular lip having a diameter slightly larger than the diameter of the central hole 43 of the female plate to penetrate into the hole and rests the circular lip on the front side of the female plate. After insertion, the female plate rests on the circular protrusion 40 and situates on top of the male plate. The thickness of the female plate rests on the circular protrusion 40. The slits 44 herein are usually aligned with the shallow trough like cavities 45 which are at 90 degrees from each other. The troughs are shallow but deep enough to temporarily lodge a nib. When the female semi-spherical shell 2 initially engages with the male semi-spherical shell 3, each rounded tipped nib 24 on the bottom side 38 of the female plate is lodged at a matching trough like cavity 45 on the bottom side 39 of the male plate 5 in such a way that the intersecting tracks 22 and 23 on the female semi-spherical shell continues through the intersecting tracks 22' and 23' respectively, on the male semi-spherical shell to form continuous intersecting tracks or rings, that is, track 22 forms a continuous track or ring with track 22' and track 23 forms a continuous track or ring with track 23'. Also in this position, there are no sliding tiles that could obstruct the rotation of one semi-spherical shell in relation to the other semi-spherical shell.

Because the outside bottom surfaces of the two semi-spherical shell are flat, that is, unobstructed except for the slightly protruding nib, after engagement of the circular protrusion 40 on the male plate 5 with the central hole 43 at the female plate 4 to form the spherical puzzle, the female semi-spherical shell 2 can be rotated relative to the male semi-spherical shell 3 about an equatorial axis perpendicular to the plane 46 formed by surfaces 38 and 39. Plane 46 divides the spherical puzzle into the two semi-spherical shells. The rotation of one semi-spherical shell can be at a direction opposite or against the position of the other semi-spherical shell. Rotation about the equatorial axis is possible when a sliding tile 26 rests at the junction 47 (see FIG. 7) where track 22 intersects with track 23 and another sliding tile 26' (not shown) rests at the opposite junction 47' where track 22' intersects with track 23' because at this position, the side 37 of the top section 27 of the sliding tile do not protrude but is rather flushed with the outer edge of side 6 and with the bottom side 38 or 39 of the plates. To illustrate, sliding tile 26*a* shown in FIG. 1 is at the junction 47. The rotation about the equatorial axis on plane 46 is usually in increments of 90 degrees at each turn, coinciding with the location of the nib and trough on the bottom sides of the female and male plates. When the semi-spherical shells are rotated, the rounded tipped nib 24 which is made of a resilient material, can transfer from one trough to another. In a 90 degree turn, one nib transfers from one trough to the adjacent trough. The cut out 25 provides the room for the nib as it temporarily recesses and revert back to its original position when it transfers from one trough 45 to another. The rounded tipped nibs 24 only protrude slightly from the bottom side of the female plate. This 90 degrees rotation about the equatorial axis on plane 46 allows track 22 to align with track 23' and consequently, the sliding tiles on these tracks.

The top outside face 30 of each tile is of a particular color or design which together with all the sliding tiles in one or two continuous ring form a predetermined pattern or design. The design may be visually detectable or it can have a set of patterned protrusions on the top section, usually on the front face 30 of the sliding tiles that can be arranged by a blind or color blind person through the touch of the hand. The spherical ring puzzle may come with the design in place on the track or scrambled to be arranged into the desired design shown in an accompanying brochure. Each track may have its own pattern or design or both tracks may form a single coordinated pattern or design. For example, one ring or sliding tiles may have one distinct color while the other ring of sliding tiles may have another distinct color or one ring of sliding tiles may have a distinct sequence of alternating colors while the other ring of sliding tiles may have another distinct sequence of alternating colors. Further, the pattern may be other than colors but other graphic designs. Also, the puzzle can come with patterns or designs of varying and increasing complexity to cater to the age and/or intelligence of the user. This can be accomplished by providing different sets of sliding tiles that can replace the sliding tiles on the puzzle or by providing a number of different rotational puzzles for each pattern or design.

The set pattern of coloration or design on the sliding tiles are arranged or disarranged by a random sequence of movements of the sliding tiles along the continuous perpendicular tracks 22, 22' or 23, 23', that is, from one track on the female semi-spherical shell to the same continuing track on the male semi-spherical shell, or from one track 22, 22' to another track 23, 23' and vice versa coupled with the rotational movement of one semi-spherical shell against the position of the other semi-spherical shell about the equatorial axis. The object of the puzzle 100 is to restore the predetermined pattern of coloration or design. To move a sliding tile 26 from one track to another, this tile must be placed at either the junction 47 or 47' (not shown). When the sliding tile is at the junction, this tile can be moved in all four directions of the tracks along 22, 22', or along 23 and 23' as shown by the arrows on FIG. 1. After the sliding tile at the junction, herein labeled as 26*a*, is moved to the desired location, another sliding tile, not necessarily adjacent to tile 26*a*, will replace tile 26*a* at the junction. The replacing sliding tile can again be moved to any desired direction or location. A series of sliding tiles in track 22 can be moved to align with the sliding tiles on track 23' by a 90 degree rotation of one semi-spherical shell in relation to the other semi-spherical shell about the equatorial axis on plane 46. The same is true for moving a series of sliding tile from track 23 to track 22'. Every 90 degree rotation will move a series of tiles from one track to another. One can also invert the spherical puzzle, that is, change the position of the female semi-spherical shell from the top to the bottom and vice-versa. Movement about the equatorial axis can shorten the time for obtaining the predetermined coloration, pattern or design. The above described movements has no predetermined sequence or order and can be repeated as many times as the user desires until the predetermined coloration, pattern or design is obtained on the tracks.

While the embodiments of the present invention have been described, it should be understood that various changes, adaptations, and modifications may be made therein without departing from the spirit of the invention and the scope of the claims.

I claim:

1. A spherical puzzle, comprising:

a first semi-spherical shell having four triangular panels held by a first plate having a front and a bottom side, the four triangular panels forming an intersecting track having a center cut running perpendicularly along an x and y axis;

a second semi-spherical shell having four triangular panels held by a second plate having a front and a bottom side, the four triangular panels forming an intersecting track having a center cut running perpendicularly along an x and y axis, the track on the x axis of the second semi-spherical shell forming a continuous track with the track on the x axis of the first semi-spherical shell and the track on the y axis of the second semi-spherical shell forming a continuous track with the track on the y axis of the first semi-spherical shell;

a plurality of sliding tiles placed on the intersecting tracks, the sliding tiles forming a predetermined pattern or design;

means for engaging the triangular panels to the first or second plates;

means for keeping the sliding tiles on the intersecting tracks;

means for engaging the first semi-spherical shell to the second semi-spherical shell; and, means for allowing one semi-spherical shell to rotate about an equatorial axis relative to the other semi-spherical shell.

2. The spherical puzzle of claim 1 wherein the triangular panels at each first and second semi-spherical shell are identical.

3. The spherical puzzle of claim 1 wherein each triangular panel cover approximately one-eight of a sphere.

4. The spherical puzzle of claim 1 wherein the triangular panel has an outer curved surface having raised ridges along three sides of the triangular panel, the raised ridges on the lateral sides recessed from the edges of the lateral sides forming a track having the center cut along the track after the triangular panels are held by the plates of the semi-spherical shells.

5. The spherical puzzle of claim 1 wherein the triangular panel has an interior supporting wall, the wall forming a hollow compartment serving as a connector for the triangular panel.

6. The spherical puzzle of claim 5 wherein the supporting wall further comprises a rib running longitudinally along an outer edge of the supporting wall.

7. The spherical puzzle of claim 1 wherein the front side of the first and second plates have an upstanding platform for engaging with a hollow compartment formed by an interior supporting wall on the triangular panel, the upstanding platform comprising a retaining hook protruding upwards from the upstanding platform for engagement with an opening on a side wall of the interior supporting wall.

8. The spherical puzzle of claim 1 further comprising nibs of resilient material aligning with the center cut along the intersecting tracks located at four positions on the bottom side of the first plate spaced at 90 degrees from each other.

9. The spherical puzzle of claim 8 wherein the tip of the nibs are rounded and hanging from one end of a cut out, the cut out providing room for the nib to recess and revert back to the original position.

10. The spherical puzzle of claim 1 wherein each track on a semi-spherical shell contain a minimum of three sliding tiles.

11. The spherical puzzle of claim 1 wherein the sliding tile has a top section having a top face and a base and a thin plate connected to the top section by a center piece situated at the center cut of the intersecting tracks, the thin plate located at an inside surface of the track with the top section located on a top surface of the semi-spherical shell and having a width larger than the width of the center cut to keep the tiles on the intersecting track.

12. The spherical puzzle of claim 11 wherein peripheral edges and corners of the top face and the base are curved and smoothened and peripheral bottom corners of the base slightly lowered resulting in a slight arching of the base.

13. The spherical puzzle of claim 1 wherein the first semi-spherical shell is engaged with the second semi-spherical shell by inserting a circular lip of a circular protrusion on the male plate into a central hole of the female plate, thereby situating the first plate on top of the second plate.

14. The spherical puzzle of claim 1 wherein the bottom surfaces of the first and second semi-spherical shells are flat after engagement except for nibs on the first semi-spherical shell and matching troughs on the second semi-spherical shell at 90 degrees from each other, the matching nib and trough allowing rotation of the first semi-spherical shell about the equatorial axis in increments of 90 degrees in relation to the second semi-spherical shell wherein one nib transfers from one trough to an adjacent trough.

15. The spherical puzzle of claim 1 wherein one sliding tile is at a junction of the intersecting track at the first semi-spherical shell and another sliding tile is at a junction of the intersecting track at the second semi-spherical shell when one semi-spherical shell rotates at a direction against the position of the other semi-spherical shell.

16. The spherical puzzle of claim 1 wherein the predetermined pattern or design on the sliding tile is visually detectable or in a set of patterned protrusion for the blind, the pattern or design in one track coordinated or independent from the pattern or design from the other track.

17. A spherical puzzle, comprising:

a first semi-spherical shell having four triangular panels held by a first plate having a front and a bottom side, the four triangular panels forming an intersecting track having a center cut running perpendicularly along an x and y axis;

a second semi-spherical shell having four triangular panels held by a second plate having a front. and a bottom side, the four triangular panels forming an intersecting track having a center cut running perpendicularly along an x and y axis, the track on the x axis of the second semi-spherical shell forming a continuous track with the track on the x axis of the first semi-spherical shell and the track on the y axis of the second semi-spherical shell forming a continuous track with the track on the y axis of the first semi-spherical shell;

an interior supporting wall for each triangular panel, the interior wall forming a hollow compartment for engagement with an upstanding platform on the front side of the first and second plate;

a retaining hook protruding upwards from the upstanding platform for engagement with an opening on a side wall of the interior supporting wall when the triangular panels engage with the first and second plates to form the first and second semi-spherical shells;

a plurality of sliding tiles comprising a top section having a top face and a base and a thin plate connected to the top section by a center piece situated at the center cut of the intersecting tracks, the thin plate located at an inside surface of the track with the top section located on a top surface of the semi-spherical shell and having a width larger than the width of the center cut to keep the tiles on the intersecting track, the sliding tiles forming a predetermined pattern or design;

means for engaging the first semi-spherical shell to the second semi-spherical shell; and, means for allowing one semi-spherical shell to rotate about an equatorial axis relative to the other semi-spherical shell.

18. The spherical puzzle of claim 1 wherein the first semi-spherical shell engages with the second semi-spherical shell by inserting a circular lip of a circular protrusion on the male plate into a central hole of the female plate, thereby situating the first plate on top of the second plate, this engagement allowing the first semi-spherical shell to rotate about an equatorial axis relative to the second semi-spherical shell.

19. A spherical puzzle, comprising:

a first semi-spherical shell having four triangular panels held by a first plate having a front and a bottom side, the four triangular panels forming an intersecting track having a center cut running perpendicularly along an x and y axis;

a second semi-spherical shell having four triangular panels held by a second plate having a front and a bottom side, the four triangular panels forming an intersecting track having a center cut running perpendicularly along an x and y axis, the track on the x axis of the second semi-spherical shell forming a continuous track with the track on the x axis of the first semi-spherical shell and the track on the y axis of the second semi-spherical shell forming a continuous track with the track on the y axis of the first semi-spherical shell;

an interior supporting wall for each triangular panel, the interior wall forming a hollow compartment for engagement with an upstanding platform on the front side of the first and second plate;

a retaining hook protruding upwards from the upstanding platform for engagement with an opening on a side wall of the interior supporting wall when the triangular panels engage with the first and second plates to form the first and second semi-spherical shells;

a circular protrusion on the male plate of the first semi-spherical shell having a circular lip engaging with the second semi-spherical shell by inserting into a central hole of the female plate, thereby situating the first plate on top of the second plate, this engagement allowing the first semi-spherical shell to rotate about an equatorial axis relative to the second semi-spherical shell; and, a plurality of sliding tiles comprising a top section having a top face and a base and a thin plate connected to the top section by a center piece situated at the center cut of the intersecting tracks, the thin plate located at an inside surface of the track with the top section located on a top surface of the semi-spherical shell and having a width larger than the width of the center cut to keep the tiles on the intersecting track, the sliding tiles forming a predetermined pattern or design.

20. The spherical puzzle of claim 19 wherein the bottom surfaces of the first and second semi-spherical shells are flat after engagement except for nibs on the first semi-spherical shell and matching troughs on the second semi-spherical shell at 90 degrees from each other, the matching nib and trough allowing rotation of the first semi-spherical shell about the equatorial axis in increments of 90 degrees in relation to the second semi-spherical shell wherein one nib transfers from one trough to an adjacent trough.

* * * * *